US006938587B2

(12) United States Patent
Thomas et al.

(10) Patent No.: US 6,938,587 B2
(45) Date of Patent: Sep. 6, 2005

(54) HAND HELD POWER TOOL

(75) Inventors: Benjamin J. Thomas, Anderson, SC (US); Kenneth M. Brazell, Piedmont, SC (US); Taku Ohi, Greer, SC (US)

(73) Assignee: Homelite Technologies, Ltd., Hamilton (BM)

( * ) Notice: Subject to any disclaimer, the term of this patent is extended or adjusted under 35 U.S.C. 154(b) by 2 days.

(21) Appl. No.: 10/396,938

(22) Filed: Mar. 25, 2003

(65) Prior Publication Data

US 2004/0187809 A1 Sep. 30, 2004

(51) Int. Cl.[7] ..... A47L 5/14
(52) U.S. Cl. ..... 123/41.56; 30/276
(58) Field of Search ..... 30/276, 275.4, 30/296.1; 172/13, 14; 123/41.56

(56) References Cited

U.S. PATENT DOCUMENTS

| | | | | | |
|---|---|---|---|---|---|
| 1,668,716 | A | | 5/1928 | Herdman et al. | |
| 1,994,614 | A | | 3/1935 | Lansing | 123/169 |
| 2,149,027 | A | | 2/1939 | Meredith | 123/169 |
| D206,373 | S | | 12/1966 | James et al. | D10/8 |
| 3,905,103 | A | * | 9/1975 | Ford et al. | 30/276 |
| 4,970,351 | A | | 11/1990 | Kirlin | 174/68.3 |
| 5,188,537 | A | | 2/1993 | Itoh et al. | 439/127 |
| D353,382 | S | | 12/1994 | Kiyooka et al. | D15/1 |
| D361,336 | S | | 8/1995 | Tinius | D15/1 |
| 5,815,928 | A | * | 10/1998 | Cline | 30/276 |
| 5,819,418 | A | * | 10/1998 | Uhl | 30/296.1 |
| 5,829,485 | A | | 11/1998 | Fatato et al. | 138/121 |
| 5,862,595 | A | * | 1/1999 | Keane | 30/124 |
| 5,926,961 | A | * | 7/1999 | Uhl | 30/296.1 |
| D416,265 | S | | 11/1999 | Kato et al. | D15/1 |
| 6,065,214 | A | * | 5/2000 | Nagashima | 30/276 |
| 6,105,258 | A | | 8/2000 | Akaike | 30/276 |
| 6,240,644 | B1 | | 6/2001 | Lawrence | 30/276 |
| 6,249,978 | B1 | * | 6/2001 | Sheldon | 30/276 |
| 6,253,415 | B1 | | 7/2001 | Honda | 15/339 |
| 6,301,788 | B1 | * | 10/2001 | Webster | 30/276 |
| 6,301,866 | B1 | * | 10/2001 | Marshall et al. | 56/233 |
| 6,751,871 | B2 | * | 6/2004 | Furnish | 30/276 |

* cited by examiner

*Primary Examiner*—Henry C. Yuen
*Assistant Examiner*—Jason Benton
(74) *Attorney, Agent, or Firm*—Harrington & Smith, LLP

(57) ABSTRACT

A power tool including a main section and a handle section. The main section includes an internal combustion engine and a housing at least partially surrounding the engine. The engine includes a cylinder, a spark plug, and a muffler. The handle shaft extending from the main section. The shaft forms a handle for the power tool and houses a drive shaft from the engine therein. The housing forms a cover section over a transmission assembly between the engine and the drive shaft. The cover section includes a scroll form to channel air flow pushed by the transmission assembly. The housing further comprises a spark plug boot to substantially prevent air from exiting the housing at the spark plug.

13 Claims, 15 Drawing Sheets

HAND HELD POWER TOOL

BACKGROUND OF THE INVENTION

1. Field of the Invention

The present invention relates to hand held power tools.

2. Brief Description of Prior Developments

U.S. Pat. No. 5,802,724 discloses a coupling for a split-boom power tool. One embodiment has a rotatable knob for clamping flanges of a coupling together to clamp two boom members within the coupling. One of the boom members has a spring loaded locating pin that projects into an aperture of the coupling. U.S. Pat. No. Des. 416,265 discloses a non-symmetrical clutch cover. Air entrance holes appear to be present in the neck of the clutch cover. The clutch cover appears tapered up towards the top where the spark plug is covered. U.S. Pat. Nos. Des. 353,382 and Des. 361,336 show spark plug protectors. U.S. Pat. No. 6,253,415 discloses a flexible protective tube 10 which houses a throttle cable and electrical wires for a blower. U.S. Pat. No. 1,668,716 discloses a door knob with a cover. U.S. Pat. No. Des. 206,373 discloses a knob with radial raised sections.

SUMMARY OF THE INVENTION

In accordance with one aspect of the present invention, a power tool is provided comprising a main section and a handle shaft. The main section comprising an internal combustion engine and a housing at least partially surrounding the engine. The engine comprises a cylinder, a spark plug, and a muffler The handle shaft extends from the main section. The shaft forms a handle for the power tool and a housing for a drive shaft from the engine. The housing forms a cover section over a transmission assembly between the engine and the drive shaft, an air inlet at the front of the housing and an air outlet at a rear of the housing. The cover section comprises a scroll form to channel air flow pushed by the transmission assembly over the transmission assembly, to the cylinder and the muffler of the engine, and out the air outlet at the rear of the housing. The housing further comprises a spark plug boot to substantially prevent air from exiting the housing at the spark plug.

In accordance with another aspect of the present invention, a power tool is provided comprising an internal combustion engine comprising a cylinder and a spark plug; and a housing at least partially surrounding the engine. The housing comprises a main section having a spark plug aperture therethrough, at least one outward extending rail extending from the main section, and a spark plug boot removably connected to the main section. The spark plug extends through the aperture in the main section of the housing. The boot is mounted on the rail, and the spark plug boot covers the rail and the aperture.

In accordance with another aspect of the present invention, a string trimmer is provided comprising a main section comprising an internal combustion engine and a starter connected to a rear end of the engine; a shaft extending from the main section having a drive shaft extending therethrough; and a bumper connected to a housing of the starter. The bumper is comprised of a different material than the housing of the starter. The different material is adapted to at least partially resiliently absorber physical force, and the bumper extends past the rear end of the housing of the starter.

In accordance with another aspect of the present invention, a power tool is provided having two sections which are movable relative to each other by a tightening system. The tightening system has a threaded shaft and a hand knob threadingly mounted on the threaded shaft. The threaded shaft has a head stationarily mounted with a first one of the sections. The hand knob has a main section threadingly mounted on the threaded shaft and an over-molded section on the main section. The overmolded section forms a raised shaped surface for more secure gripping by a user.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
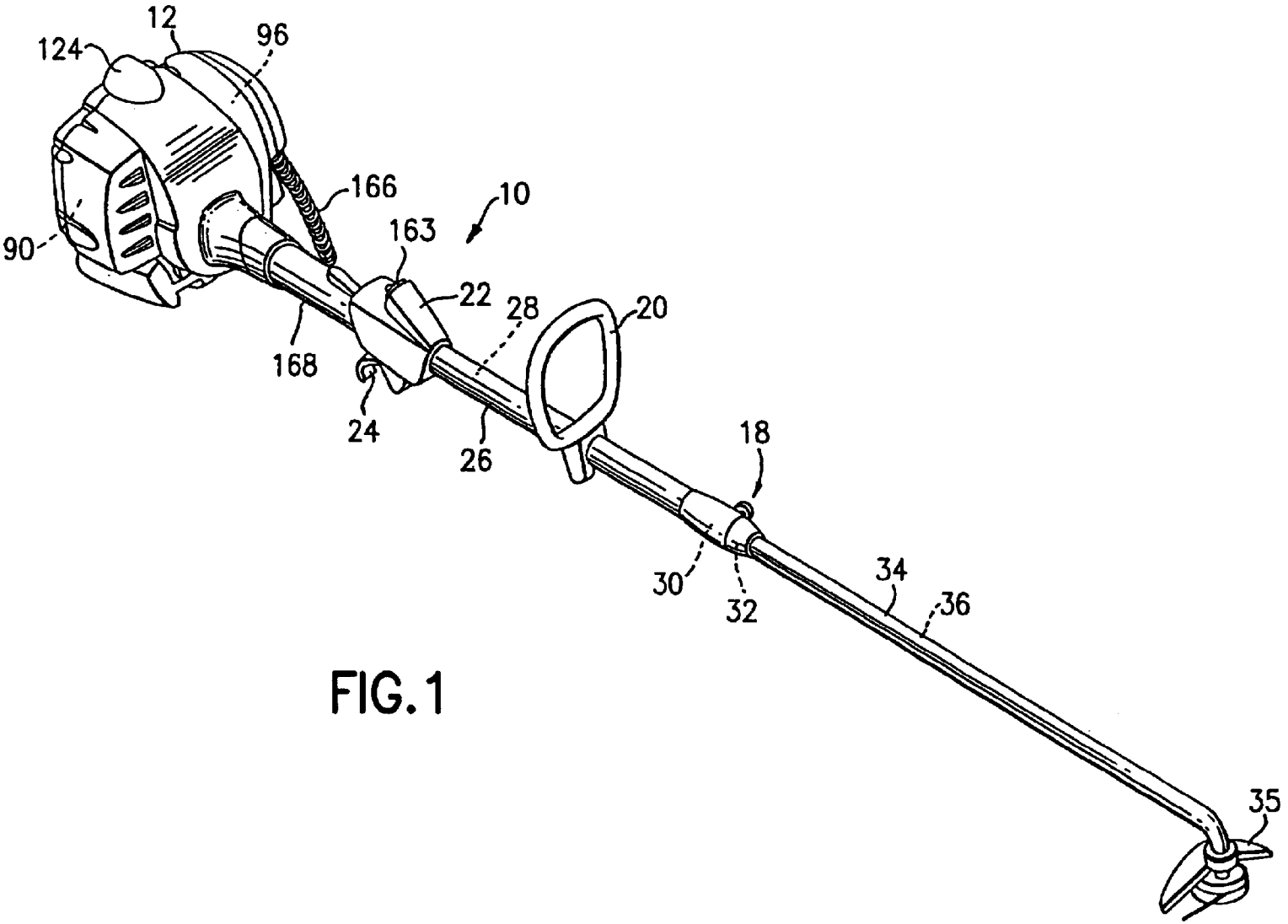
FIG. 1 is a perspective view of a hand operated power tool incorporating features of the present invention.

Referring to FIG. 1, there is shown a perspective view of a power tool 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The power tool 10 in this embodiment is a string trimmer. However, in alternate embodiments, features of the present invention could be used in any suitable type of power tool, such as any type of power tool comprising an internal combustion engine, or which comprises a rotatable knob, which as a starter which is adapted to be placed on the ground. The power tool is a modular reconfigurable tool of a split-boom type adapted to have any one of a number of lower end boom members or attachments 16 attached thereto for performing different functions such as a blower, a hedge trimmer, a pruner, etc., similar to those described in U.S. Pat. No. 5,802,724 which is hereby incorporated by reference in its entirety. However, features of the present invention could be used with any suitable type of power tool split-boom attachment. In an alternative embodiment, features of the present invention could be used in any suitable type of string trimmer or brush cutter, including a string trimmer which does not comprise a split-boom configuration.

The power tool 10 generally comprises a motor 12, a first boom member 14, a second boom member 16 and a coupling system 18. However, in alternate embodiments, features of the present invention could include additional or alternative components then those described below. The motor 12, in the embodiment shown, comprises an internal combustion engine. However, in alternate embodiments, the motor 12 could comprise an electric motor, such as a battery operated motor.

The first boom member 14 extends from the front end of the motor 12. The tool includes a front handle 20 and a user control 22 attached to the front boom member 14. However, in alternate embodiments, any suitable type of handle system could be provided. The user control 22 includes a throttle trigger 24. However, in alternate embodiments, any suitable type of user control could be provided. The first boom member 14 generally comprises a straight tubular frame 26 and a first rotatable drive shaft 28 extending through the frame 26. In an alternate embodiment, the frame 26 could have a non-straight shape. The first rotatable drive shaft 28 is connected to an output from the motor 12 and extends to a front end 30 of the first boom member 14.

Figure 2:
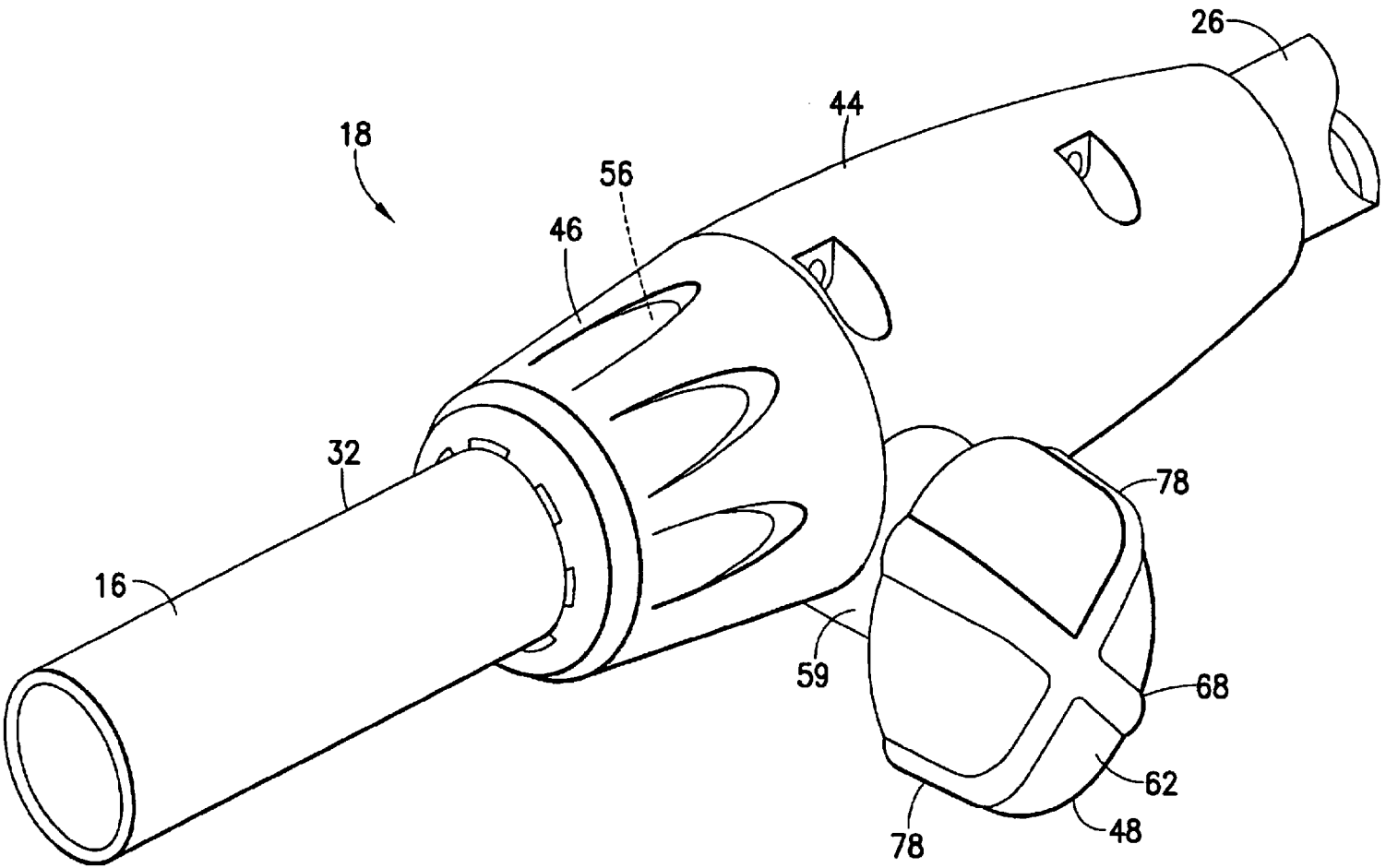
FIG. 2 is an enlarged partial perspective view of the coupling system of the power tool shown in FIG. 1.
Figure 3:
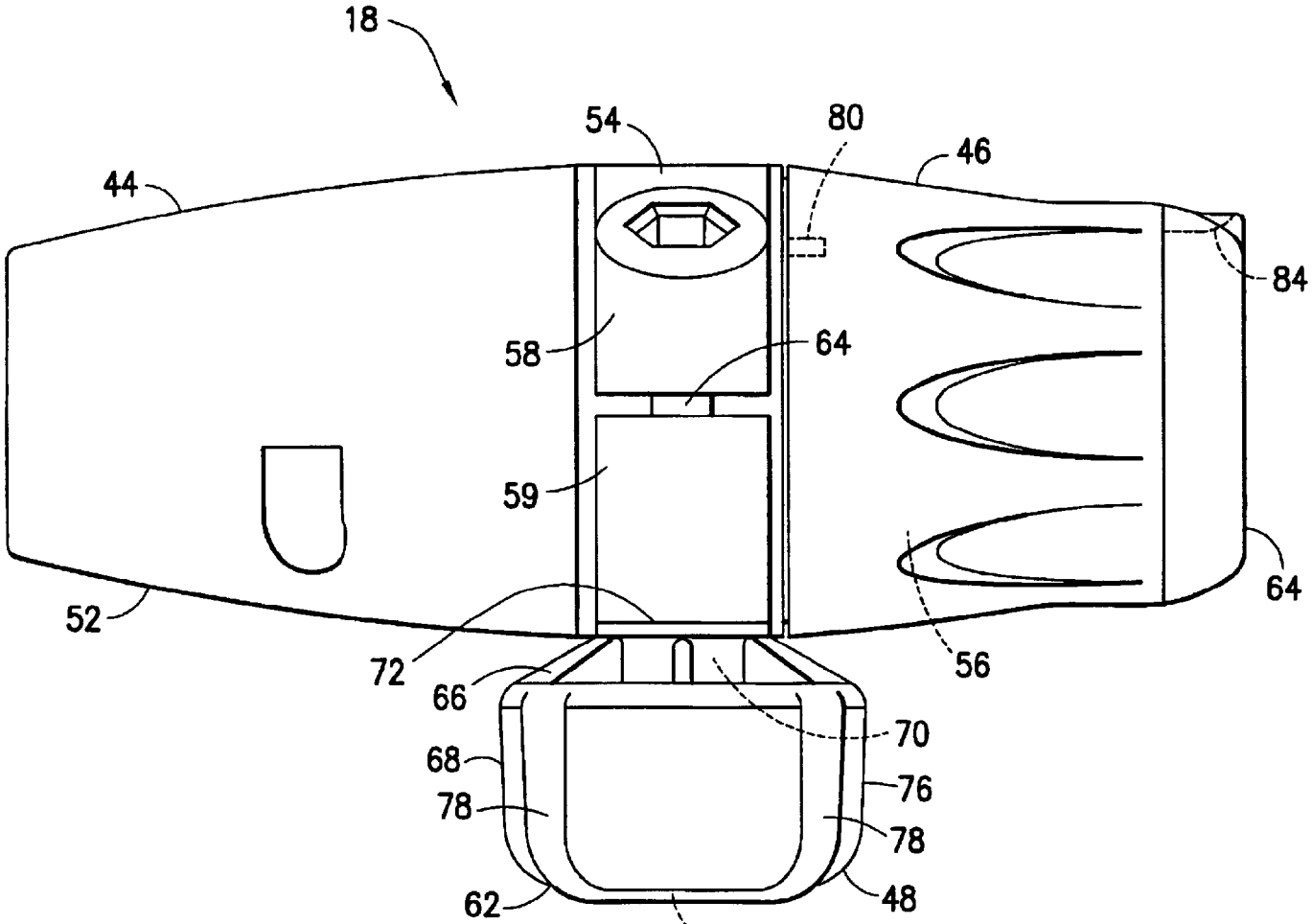
FIG. 3 is a bottom plan view of the coupling system shown in FIG. 2.
Figure 4:
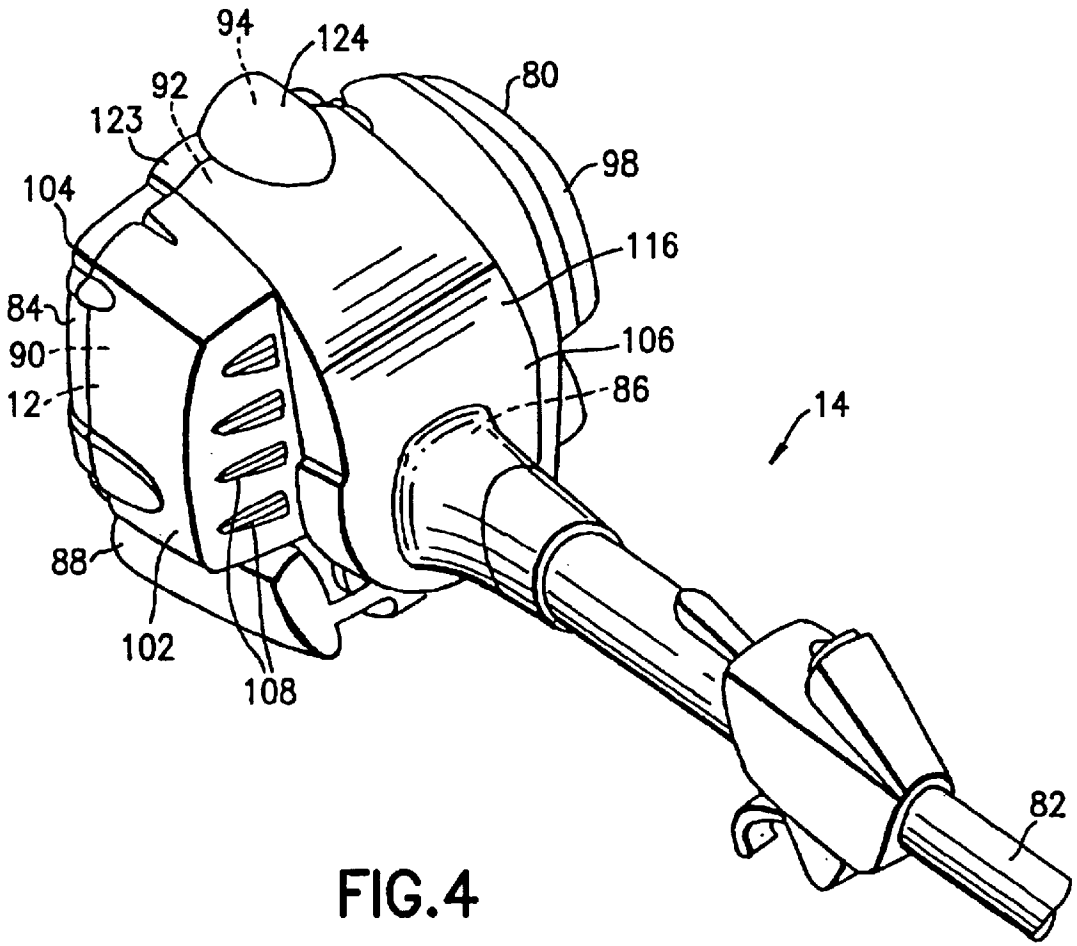
FIG. 4 is a perspective view of the main section of the first boom member of the power tool shown in FIG. 1.
Figure 5:
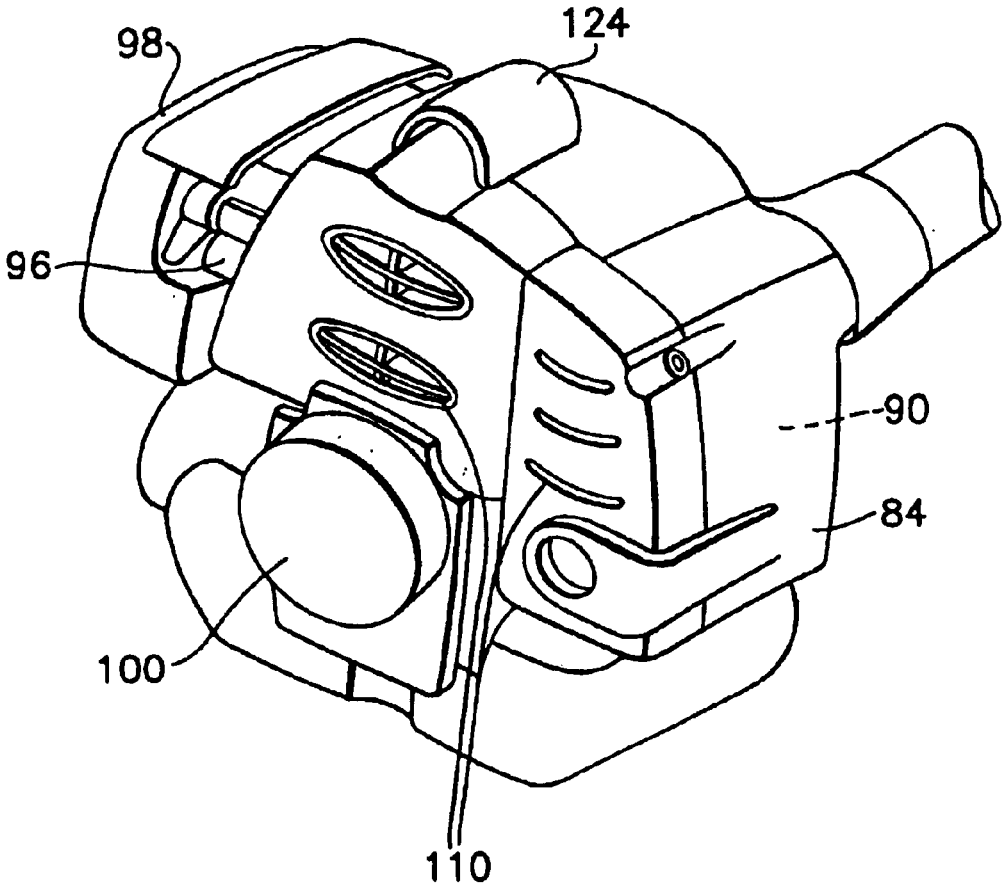
FIG. 5 is a perspective view of the main section shown in FIG. 4 taken from a rear end.
Figure 6:
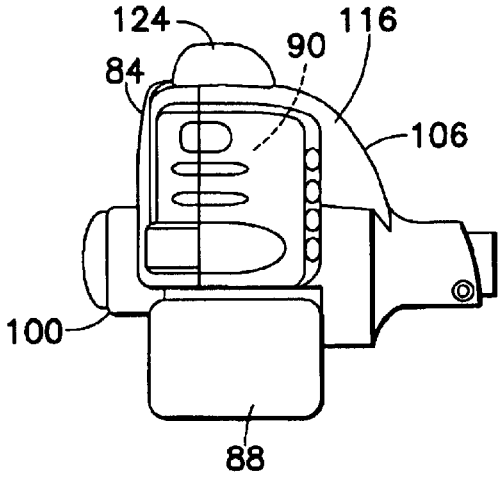
FIG. 6 is a right side elevational view of the main section shown in FIG. 5.
Figure 7:
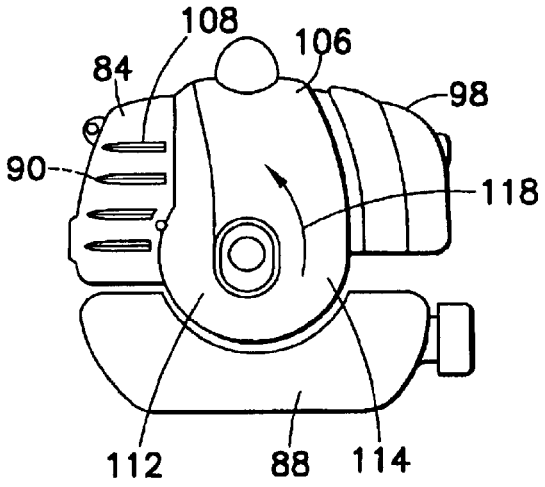
FIG. 7 is a front side elevational view of the main section shown in FIG. 5.
Figure 8:
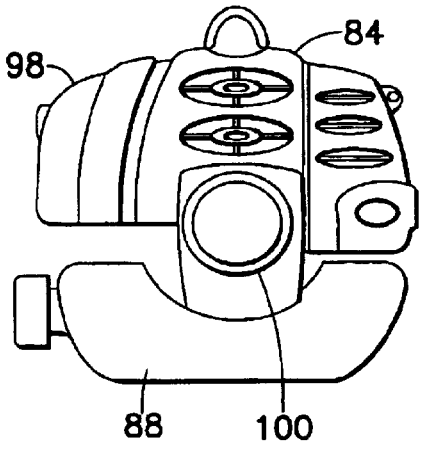
FIG. 8 is a rear side elevational view of the main section shown in FIG. 5.

Referring also to FIGS. 2 and 3, the coupling system 18 is used to connect a rear end 32 of the second boom member 16 to the front end 30 of the first boom member 14. The second boom member or working end assembly 16 includes a tubular frame 34, a second rotatable drive shaft, and a working end 35, such as a string trimmer head, located at a distal, front end of the tubular frame 34. The coupling system 18 comprises the features of the coupling system described in U.S. patent application Ser. No. 10/261,567 filed Sep. 30, 2002 which is hereby incorporated by reference in its entirety.

In the embodiment shown, the rear end 32 of the second boom member 16 also comprises a spring loaded locating member. A leaf spring connects the locating member to the tubular frame 34. The locating member extends through a hole in the tubular frame 34. The locating member can be depressed into the tubular frame 34. The spring can bias the locating member in an outward direction. The locating member and spring form part of a locating system for initially locating the second boom member 16 relative to the first boom member 14 at one of three possible angular orientations; approximately 90 degrees apart. However, in alternate embodiments, any suitable type of locating system for initially locating the second boom member 16 relative to the first boom member 14 could be provided. The initial locating system might be adapted to initially locate the second boom member 16 relative to the first boom member 14 at more or less than three possible angular orientations and/or at more or less than 90 degree offsets.

A rear end of the second rotatable drive shaft 36 is adapted to removably mate with a front end of the first rotatable drive shaft 28 as is known in the art, such as by use of a connector. Thus, rotation of the first rotatable drive shaft 28 causes the second rotatable drive shaft 36 to rotate. In an alternate embodiment, the power tool 10 could comprise electrical conductors extending through the tubular frames 26, 34 rather than the drive shafts 28, 36. The connector at the coupling system could comprise an electrical connector to removably connect the electrical conductors to each other.

The coupling system 18 generally comprises a first section 44, a collar or second section 46, and a tightening system 48. The first section 44 is fixedly connected to the front end 30 of the first boom member 14. The first section 44 generally comprises a rear portion 52, a middle portion 54, and a front section 56. The rear portion 52 comprises a general tubular shape. The front end 30 of the first boom member 14 extends into the center aperture of the rear portion 52. The front end 30 and the rear portion 52 are fixedly and stationarily connected to each other by fasteners, but any suitable fastening system could be used.

The middle portion 54 includes two cantilevered flanges 58, 59. The flanges 58, 59 have a home position wherein the flanges are spaced from each other. However, the flanges 58, 59 can be deflected towards each other by the tightening system 48 to reduce the cross sectional size of the main channel through the first section 44 at the middle portion 54. The tightening system 48 generally comprises a handle or knob 62, and a threaded bolt or shaft 64. The bolt 64 is stationarily attached to the far flange 58, and movably extends through the near flange 59.

The knob 62 is rotatably connected to the threads on the bolt 64 such that rotation of the knob relative to the bolt causes the knob to longitudinally move inward or outward in the bolt. The inner end of the knob rests against the near flange 59 such that the knob and bolt can deflect the flanges 58, 59 towards each other. The flanges 58, 59 can automatically return to their home, spaced positions when the knob 62 is moved outward on the bolt.

As noted above, the flanges 58, 59 can be deflected towards each other by the tightening system 48 to reduce the cross sectional size of the main channel through the first section 44 at the middle portion 54. Thus, the first section 44 can be tightened onto the frame 34 of the second boom member 16 to clamp the frame 34 to the first section 44 and, thus, stationarily attach the frame 34 to the frame 26 of the first boom member 14. However, this clamping feature can be unclamped by loosening the tightening system 48 to allow the first and second boom members to be decoupled. In an alternate embodiment, any suitable type of clamping system could be provided. Alternatively, the additional clamping system might not be provided.

The front section 56 of the first section 44 comprises a general tubular shape and extends in a forward direction from the middle portion 54 in a general cantilevered fashion. A bottom side of the front section 56 could comprise a slot therethrough along its length. The front section 56 has a main channel therethrough which is sized and shaped to receive the rear end 32 of the second boom member 16. The front section 56 also comprises three apertures therethrough. The apertures are sized and shaped to allow the locating member to project therethrough. The apertures are preferably spaced about 90 degrees apart along the center axis of the main channel of the front section 56. However, in alternate embodiments, any suitable angle could be provided.

The second section 46 is movably mounted to the first section 44 at the front section 56. In the embodiment shown, the second section 46 is rotatably mounted to the first section 44 for rotation about the same axis as the center channel of the first section 44 and the center axis of the second boom member 16 at the coupling. The second section 46 comprises a general ring or collar shape. In the embodiment shown, the coupling system 18 includes a front fastener 64 attached to the front end of the front section 56. The second section 46 is rotatably captured between the fastener 64 and the front of the middle portion 54. However, in alternate embodiments, any suitable system for movably attaching the second section to the first section could be provided.

The second section 46 comprises a center channel, cam surfaces, and a spring. The center channel is sized and shaped to be rotatably mounted on the front section 56. The cam surfaces are adapted to dislodge the locating member from the one of the apertures in the front section 56 when the collar 46 is rotated by a user. The spring is adapted to return the collar to its home position when the collar is released by the user.

The handle or knob 62 generally comprises a main section 66 and an overmolded section 68. The main section 66 can be made of any suitable material, such as metal or molded plastic. The main section 66 comprises a threaded aperture 70 and a pressure contact surface 72. The pressure contact surface 72 contacts the outer side of the near flange 59. The threaded aperture 70 receives the threaded end of the bolt 64 therein. Thus, when the knob 62 is tightened onto the bolt 64, the pressure contact surface 72 can press the near flange 59 inward. The overmolded section 68 is overmolded onto the main section 66. In a preferred embodiment, the overmolded section 68 comprises a general X shape. However, in alternate embodiments, the overmolded section could comprise any suitable type of shape(s).

The overmolded section 68 is formed of a different material than the material used to form the main section 66. The overmolded section 68 forms a raised shaped surface for more secure gripping by a user. The overmolded section 68 extends along an outer end 74 of the main section 66 and extends along an adjacent outer generally circular side 76 of the main section 66. The overmolded section 68 forms raised ridges 78 on the outer circular side 76.

The overmolded section 68 could be overmolded onto the entire sides 74, 76 with varying degrees of thickness to provide the shaped surfaces of the overmolded section. By providing the overmolded section onto the main section, an enhanced gripping feature is provided for the user. This may be particularly advantageous for a person who does not comprise good hand strength. By providing the contoured shaped of the section 68 by means of an overmolding process, a manufacturer can use a pre-existing knob as the main section 66 and merely add the overmolding process to form a new knob with the contoured shape of the section 68. The overmolding process could also be used to merely enlarge the diameter of a pre-existing knob. Thus, a manufacturer does not need to replace existing knob molding dies or replace existing prior conventional knob inventory. The material used to form the overmolded section could also comprise a polymer or rubber material which has an enlarged coefficient of friction for better gripping.

Referring now to FIGS. 4–8, the first boom member 14 comprises a main section 80 and a handle shaft 82. The main section 80 includes the motor 12, a housing 84, and a transmission 86. The motor 12 comprises an internal combustion engine with a fuel tank 88, a muffler 90, a cylinder 92, a spark plug 94, a carburetor 96 and an air filter located inside an air filter housing 98. The main section 80 also comprises a starter 100 connected to a rear end of the motor 12. The starter 100 is a general pull cord starter.

The housing 84 comprises a main section 123 and a spark plug boot 124. The main section 123 is comprised of two molded plastic pieces comprising a front piece 102 and a rear piece 104 which are connected to each other by fasteners. The front piece 102 forms a cover section 106 over the transmission assembly 86. The transmission assembly 86 connects the engine 12 to the drive shaft 28 in the handle shaft 82. The transmission assembly 86 comprises a clutch. However, in an alternate embodiment, the transmission assembly could comprise any suitable type of transmission. The cover section 106 forms a clutch cover. As seen best in FIGS. 4, 6 and 7, the clutch cover 106 has a general air scroll form. This form increases the efficiency of air flow in order to cool the engine. The scroll form helps to increase air flow for better cooling of the cylinder 92, muffler 90 and the clutch drum of the transmission assembly 86.

The housing 84 includes an air inlet 108 at the front of the housing and an air outlet 110 at the rear of the housing. The inlet 108 and outlet 110 each comprise multiple apertures. The general air scroll form comprises the three-dimensional shape shown wherein the air flow path increases from section 112 to section 114 at the opposite side of the clutch drum and expands upward and rearward towards the top of the cylinder at section 116. Thus, air flow is directed as indicated by arrow 118 towards the cylinder and muffler in a rearward direction.

Figure 9:
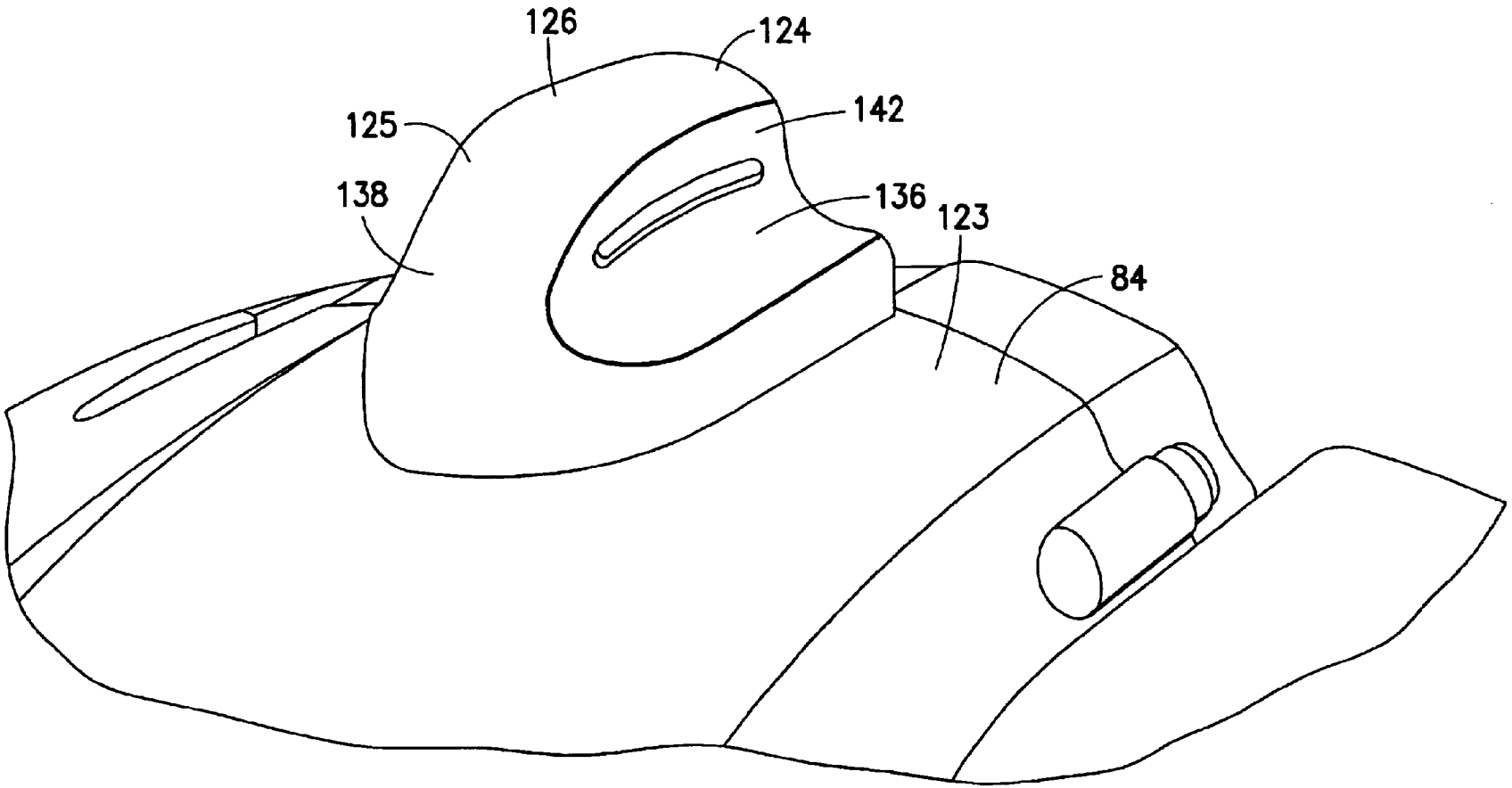
FIG. 9 is an enlarged perspective view showing the top of the housing of the main section shown in FIGS. 4–8.
Figure 10:
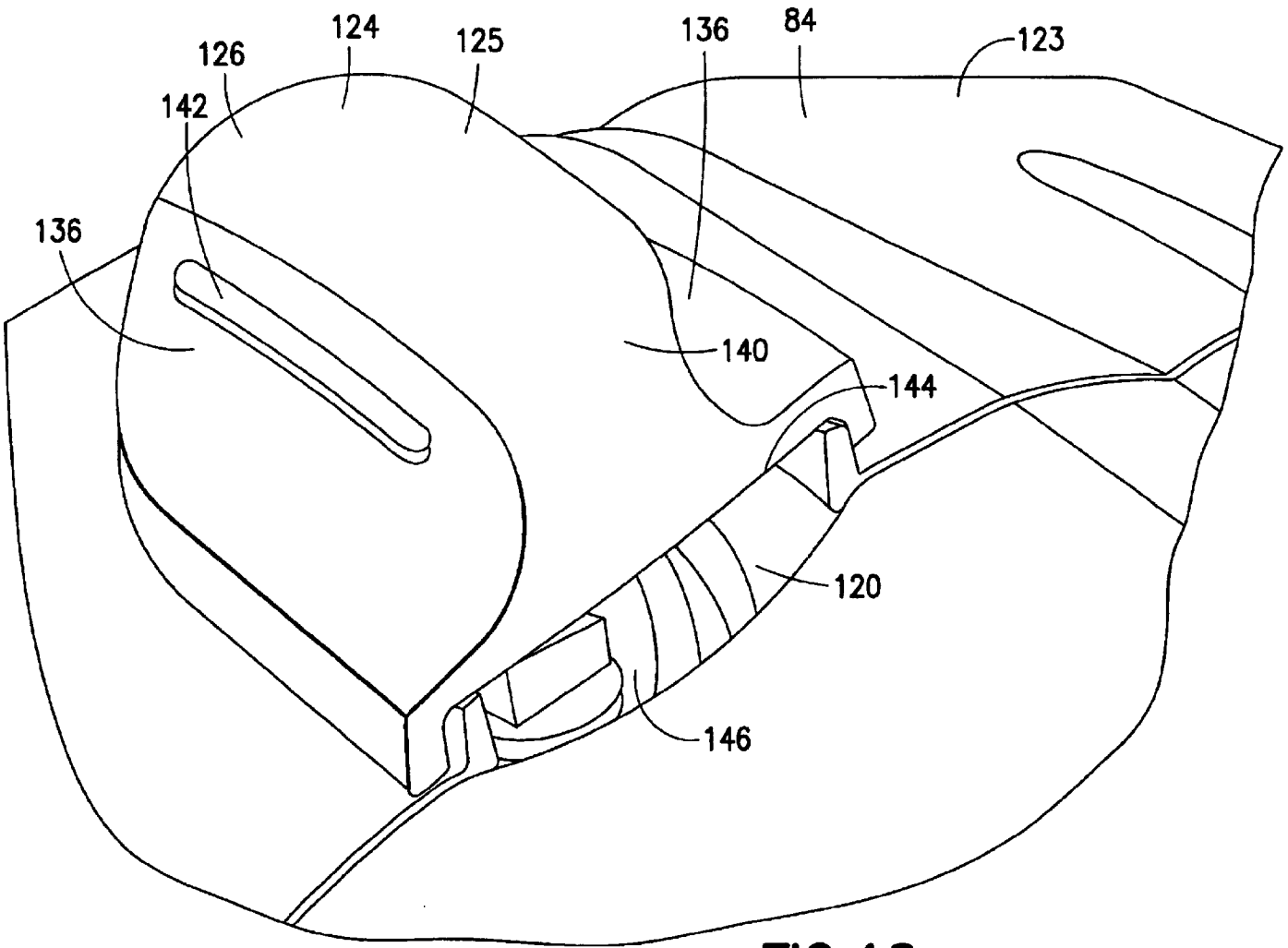
FIG. 10 is a perspective view of the top of the housing shown in FIG. 9 taken from a rear end.
Figure 11:
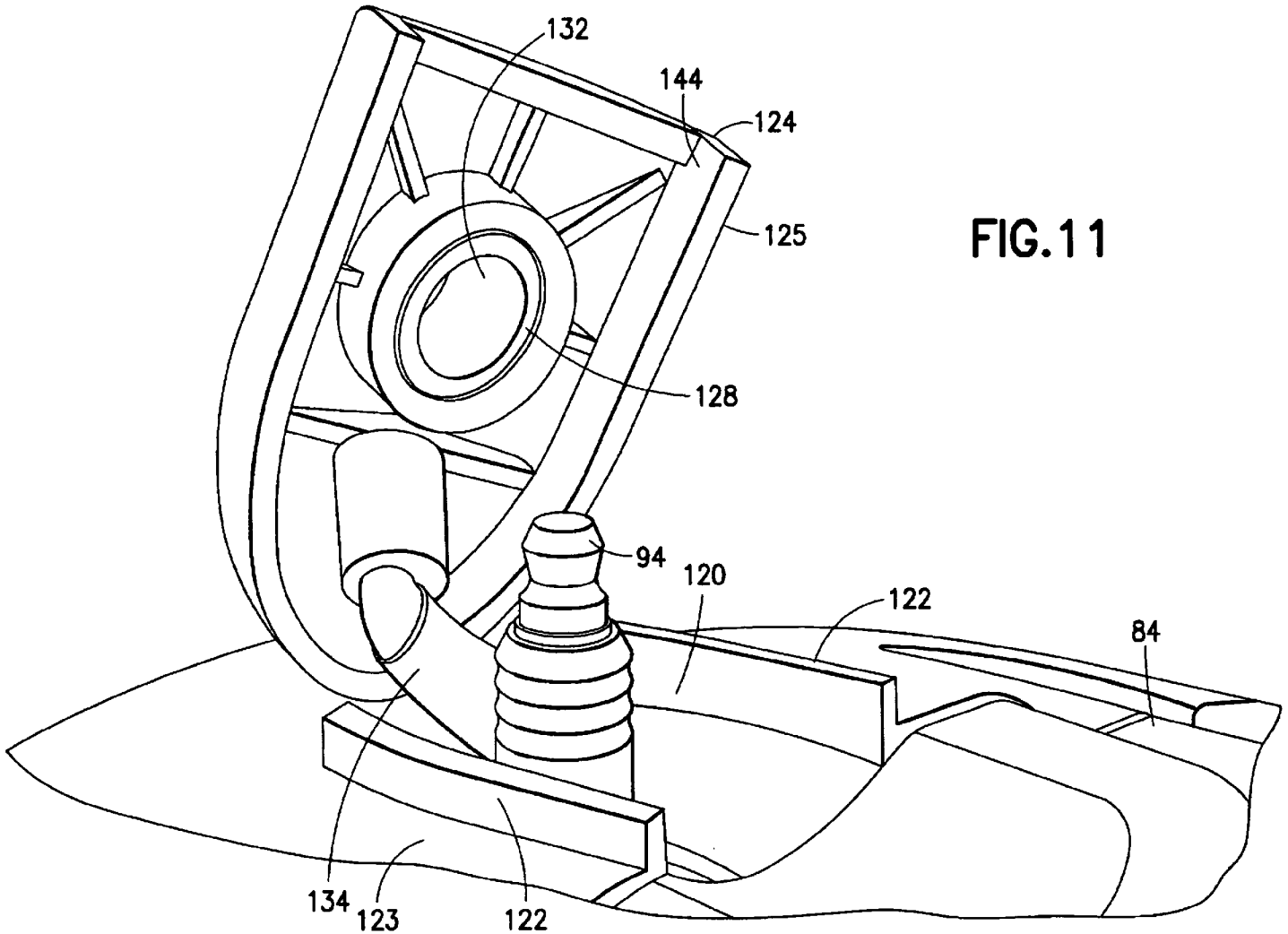
FIG. 11 is a perspective view of the top of the housing shown in FIGS. 9 and 10 with the spark plug boot being removed from the spark plug and main section of the housing.

Referring also to FIGS. 9–11, the top of the housing 84 comprises an aperture 120 therethrough. The spark plug 94 extends from the top of the cylinder 92 through the aperture 120. The housing further comprises outward extending rails 122. The rails 122 extends upward from the top of the main section 123 of the housing 84. As noted above, the housing 84 further comprises the spark plug boot 124 connected to the main section 123 of the housing. The spark plug boot 124 is removably connected to the main section 123.

The spark plug boot 124 comprises a housing 125 which is a one-piece member preferably comprised of molded rubber material. The housing 125 generally comprises an outer section 126 and an interior plug section 128. The outer section 126 is adapted to be snap lock mounted or friction mounted onto the rails 122 extending upward from the main section 123. As shown best in FIG. 11, the two rails 122 taper inwardly towards the front of the aperture 120. The boot 124 receives the rails 122 therein. The rails 122 provides structural support to the boot 124 to protect the top of the spark plug 94 from being inadvertently broken off.

In an alternate embodiment, the main section 123 might comprise more or less than two rails or, the rails might be replaced by other suitable projections. In another alternate embodiment, the housing 125 might comprise downward projections which extend into the aperture 120 to mount the boot 124 to the main section 123.

The spark plug boot 124 also comprises an electrical connector 132 inside the interior plug section 128. The electrical connector 132 is adapted to be removably connected to the top of the spark plug 94. The spark plug boot 124 is molded onto an electrical ignition wire 134 of the ignition system. The ignition wire 134 is connected to the electrical connector 132. Thus, the spark plug boot 124 provides two functions. The spark plug boot 124 functions as an electrical connector for connecting the ignition wire 134 to the spark plug 94 and, the spark plug boot functions as a structural shield over the end of the spark plug 94 which is structurally connected with the housing 84 (i.e., a part of the housing 84).

The housing 125 of the spark plug boot 124 comprises two lateral finger grip side grooves 136 and substantially closed front and rear ends 138, 140. The housing 125 comprises a general elongate shape along its length from front to rear. The housing 125 also comprises raised ridges 142 in the lateral finger grip side grooves 136. The combination of the grooves 136 and raised ridges 142, and the elongate longitudinal shape of the grooves 136 combined to provide a good gripping structural configuration for a user to grasp the boot 124 for removing it from the spark plug 94 if the spark plug needs to be removed or serviced.

Although the rear end 140 of the boot 124 is substantially closed, the rear end includes a bottom slot 144 therein. When the spark plug boot 124 is attached to the housing 84 as shown in FIG. 10, the slot 144 provides an open aperture 146 between the boot 124 and the housing 84. The aperture 146 is located only at the rear end of the boot 124. The housing 125 of the boot 124 substantially closes the aperture 120 except at the aperture 146. The shapes of the housing 84 and the housing 125 combined to form a general chimney shape with the aperture 146 functioning as an outlet to that chimney shape. Thus, heat from the inside the housing 84 can efficiently move out of the housing 84 through the chimney shape provided by the housing 84, housing 125, and aperture 146. The housing 84 can substantially enclose the cylinder of the engine, but heat can be effectively removed to prevent the heat from damaging the housing 84.

Figure 12:
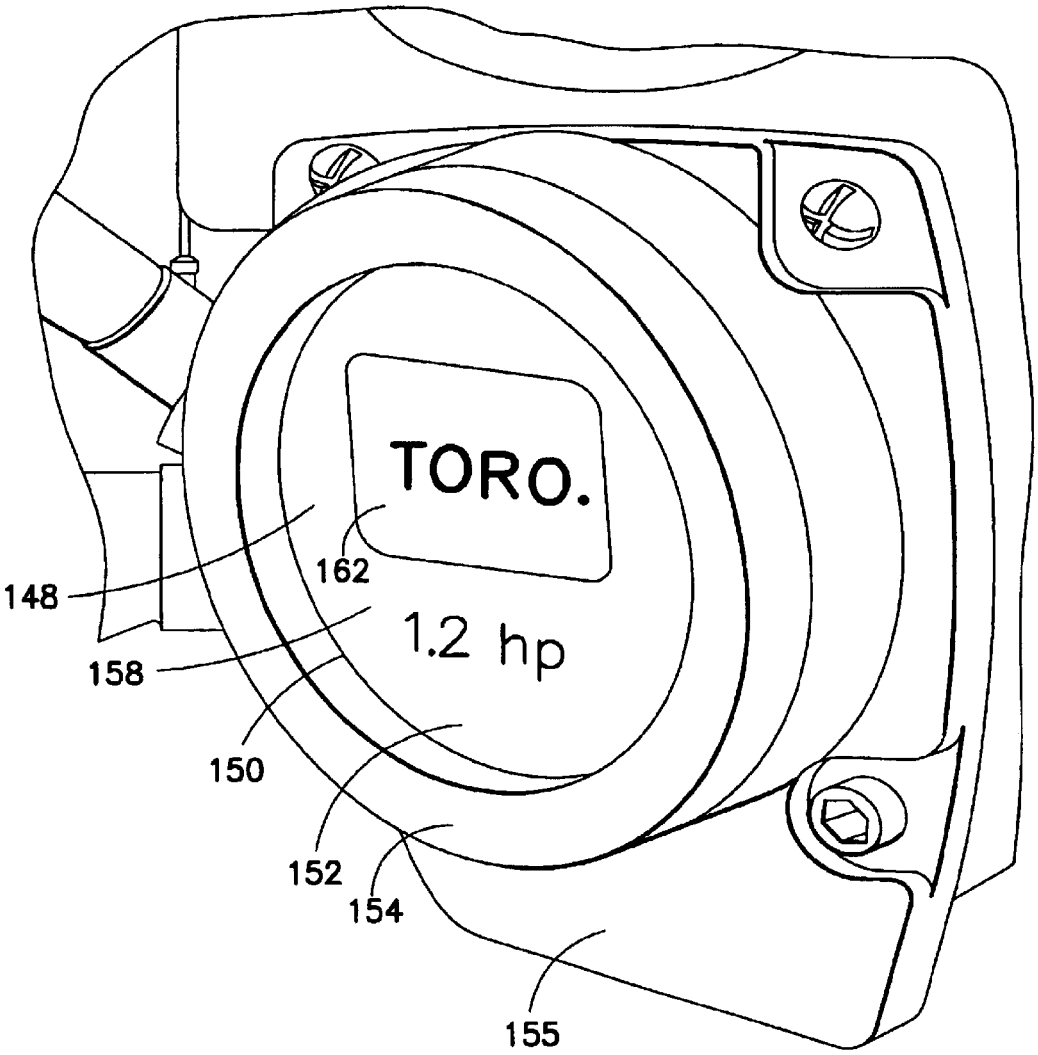
FIG. 12 is a perspective view of a portion of the rear of the power head shown in FIG. 5.
Figure 13:
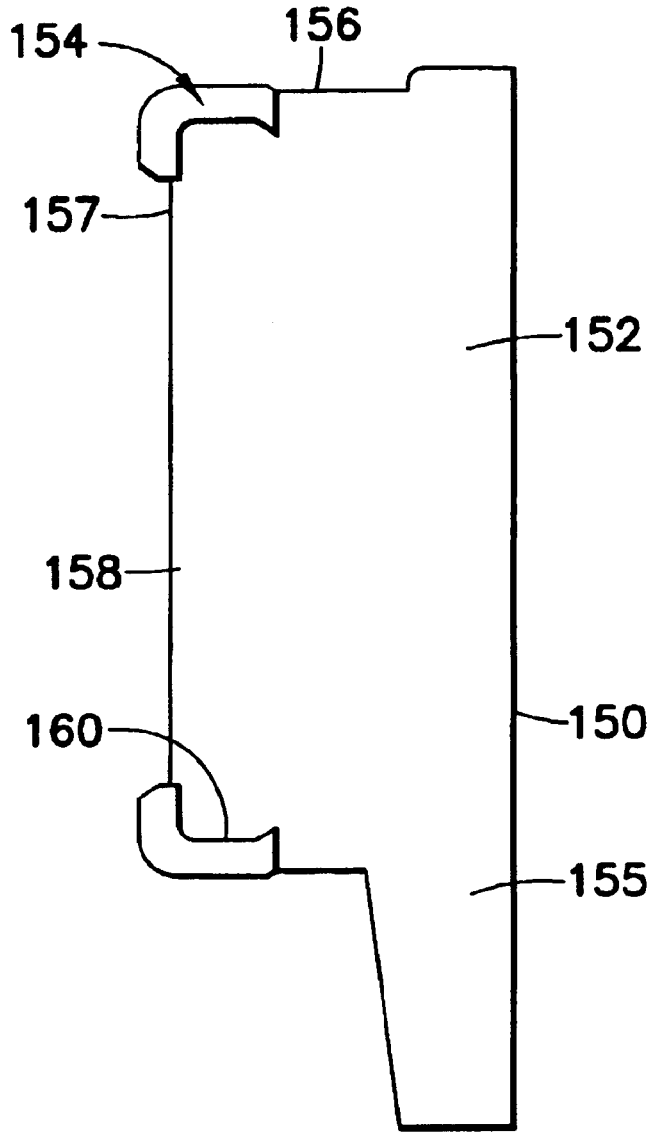
FIG. 13 is a schematic cross sectional view of the housing of the starter shown in FIG. 12.

Referring now also to FIGS. 12 and 13, the rear side of the tool 10 is shown. The tool 10 comprises a starter 148. The starter is a conventional pulled cord starter except for its housing 150. The housing 150 is attached to the rear side of the crankcase of the engine 12. In the embodiment shown, the housing 150 comprises a main housing member 152 and a bumper 154. The main housing member 152 can be comprised of a suitable material such as metal or plastic. The bumper 154 is comprised of a molded rubber or resilient polymer material.

The main housing member 152 comprises a mounting section 155 and a rearward extending tube section 156. The tube section 156 comprises a substantially flat end 158. The tube section 156 also comprises an annular groove 160 at the end 158. The annular groove 160 surrounds a portion of the exterior lateral side of the tube section.

The bumper 154 comprises a general ring shape with an open center aperture 157. The bumper 154 surrounds a portion of the exterior lateral side of the tube section at the groove 160. The bumper 154 also extends over an outer perimeter of the rear end 158. Thus, the bumper 154 comprises a general cross sectional L shape. The bumper 154 extends beyond the rear end 158 of the main housing member 152. The bumper 154 can be attached to the main housing member 152 by any suitable means, such as adhesive or glue. However, in a preferred embodiment, the bumper 154 is overmolded onto the main housing member 152. As noted above, the bumper 154 comprises a general ring shape with an open center aperture 157. A manufacturer often places indicia 162 on the flat rear end 158, such as a label or other printed matter. The general ring shape of the bumper 154 allows manufacturers to continue to do this without the indicia being obstructed by the bumper.

When an operator changes an attachment for a split boom type of tool or cleans the trimmer head (whether or not a split boom type of tool), the string trimmer is usually placed on its tail or rear end. For the configuration where the starter pack is located at the rear end of the tool, the starter pack usually takes all the impact of being placed on the ground or a hard surface, such as a concrete floor in a user's garage. This could cause the starter to be damaged. Damage to the starter housing could interfere with the proper operation of the pull cord starter system, such as preventing the pulley inside the starter housing from fully retracting the pull cord.

With the present invention, the bumper 154 can at least partially absorb the impact. Thus, the bumper 154 can prevent the main housing member 152 from being damaged by this impact. The bumper ring 154 can be overmolded or glued onto the starter housing 150, and has a ring shape to maintain an open space for a user to view the label 162. In an alternate embodiment, the bumper 154 could comprise any suitable type of shape. For example, the bumper 154 might not comprise the viewing aperture 157. In addition, any suitable type of connection could be provided between the bumper and the starter housing, such as a snap mount attachment.

Referring now particularly to FIGS. 1 and 14–16, the user control 22 is connected to the carburetor and ignition system of the tool by control cables 164, 165 and 167. The first control cable 164 comprises a throttle control cable which is connected between the throttle trigger 24 and the carburetor 96. The second and third control cables 165, 167 comprise electrical wires which are connected between the switch 163 and the ignition system of the engine 12. The tool 10 also comprises a flexible corrugated plastic tube 166. The tube 166 extends between the user control 22 and an area approximate the carburetor 96. The tube 166 is provided to group the control cables together and protect the control cables inside a housing (i.e., inside the tube 166).

Figure 14:
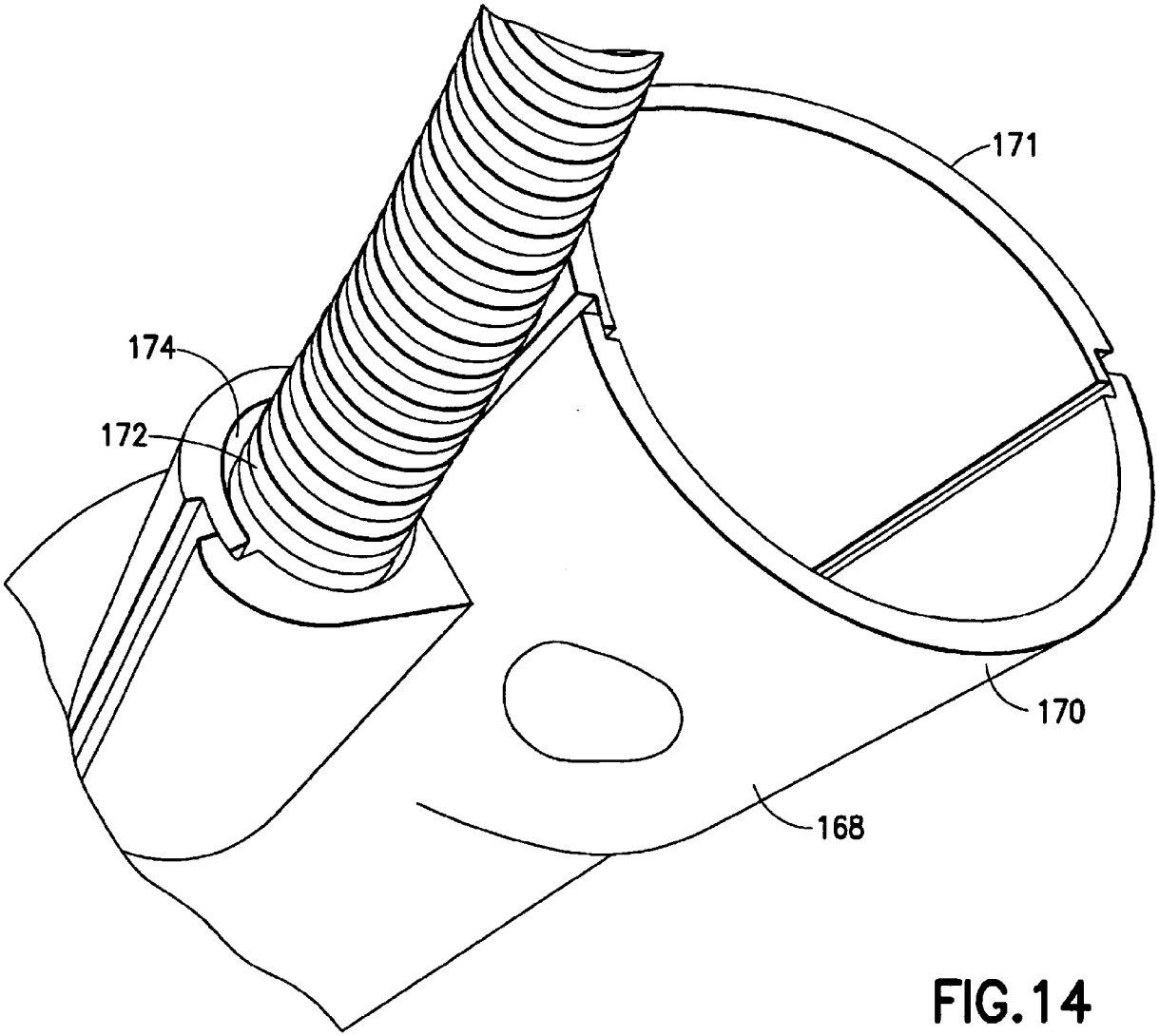
FIG. 14 is a partial perspective view showing the connection of the corrugated tube to the handle section of the frame of the first boom member.
Figure 15:
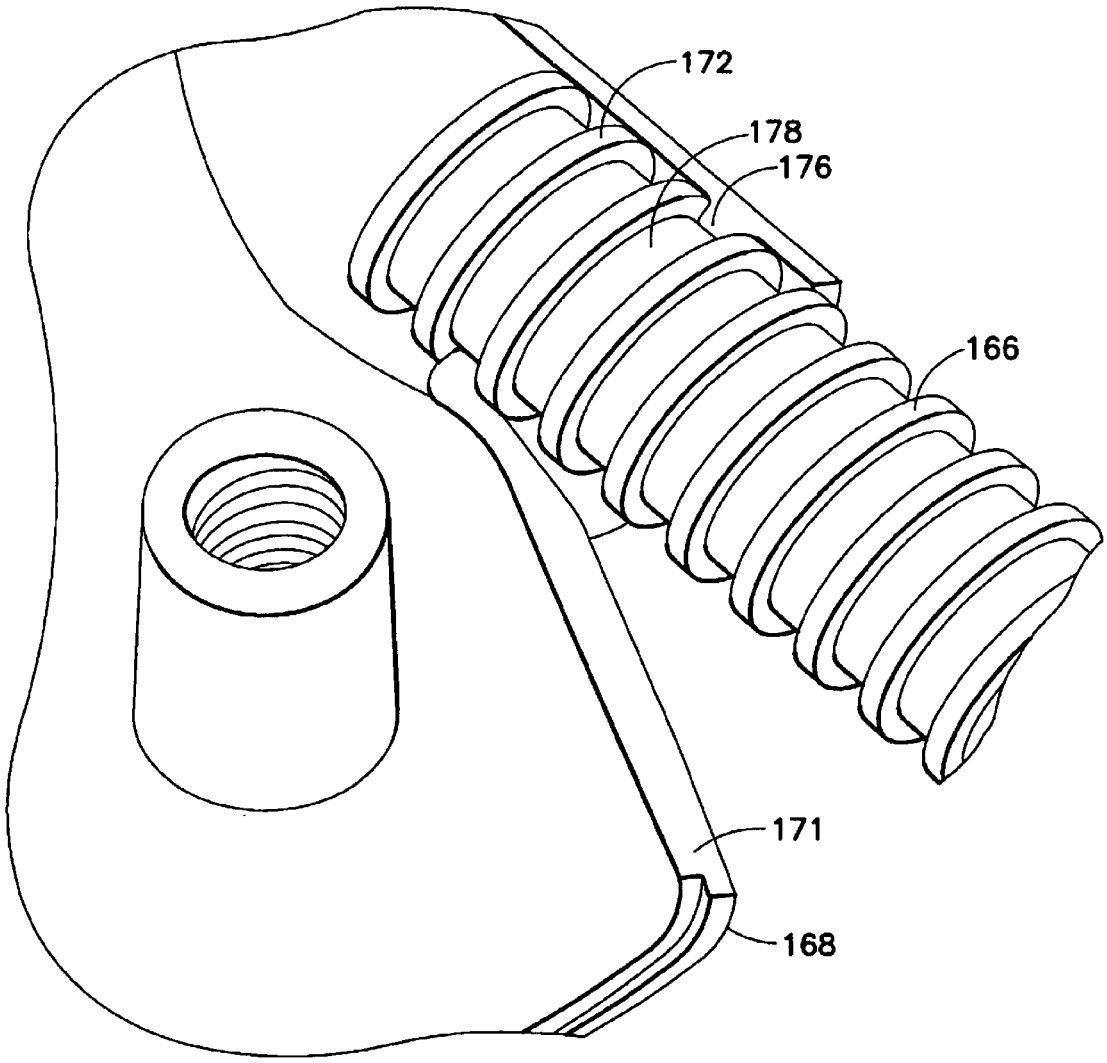
FIG. 15 is a partial perspective view showing the connection of the corrugated tube to one piece of the handle section shown in FIG. 14.

Referring particularly to FIGS. 14 and 15, the frame 26 of the first boom member 14 comprises a handle section 168. In the embodiment shown, the handle section 168 comprises a general clam shape design with two pieces 170, 171. The handle section 168 forms a tube outlet 174. A first end 172 of the corrugated tube 166 extends into the outlet 174 and is fixedly attached to the handle section 168 at the outlet. More specifically, the two pieces 170, 171 comprise radially inwardly projecting ribs 176. The ribs 176 extend into grooves 178 of the corrugated tube 166 to stationarily attach the first end 172 of the tube to the handle section 168. Thus, no additional fastener is required to attach the tube 166 to the handle section 168. A fixed attachment is accomplished when the two pieces 170, 171 are merely assembled with each other with the corrugated tube received at the outlet 174. However, in alternate embodiments, any suitable type of system for attaching the corrugated tube to the handle section or the user control could be provided.

Figure 16:
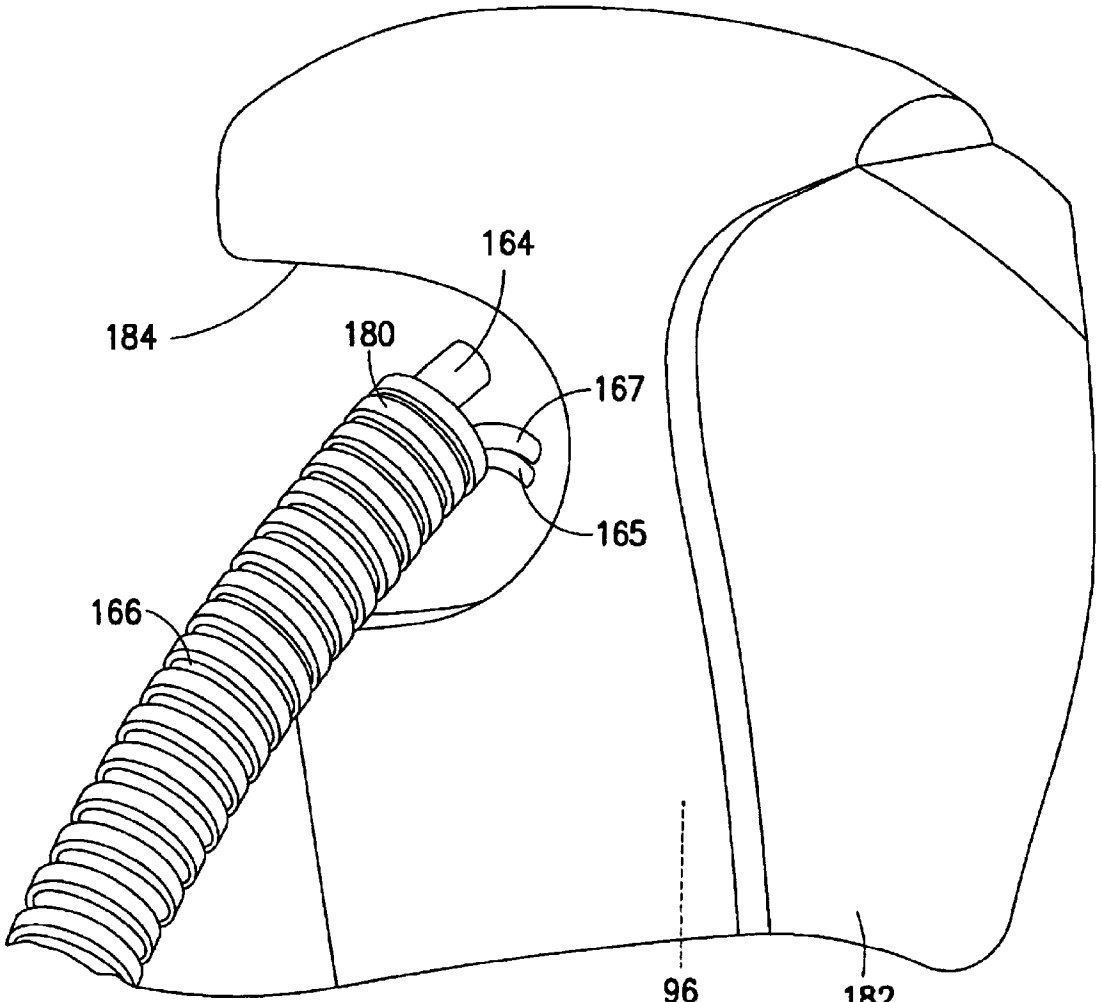
FIG. 16 is a partial perspective view showing the position of the opposite end of the corrugated tube at the carburetor cover.

Referring particularly to FIG. 16, the corrugated tube 166 comprises an opposite second end 180. The opposite second end 180 extends to the general vicinity of the carburetor 96. In the embodiment shown, the tool 10 comprises a carburetor cover 182. The carburetor cover 182 substantially encloses the carburetor 96 and also functions as an air filter cover. In the embodiment shown, the front of the carburetor cover comprises an aperture 184. The second end 180 of the corrugated tube 166 extends into the aperture 184 but is not fixedly attached to the cover 182. Instead, the second end 180 is able to move in the aperture 184. The control cables 165, 167 extend out of the second end 180 of the corrugated tube into an area inside the carburetor cover 182. However, in alternate embodiments, any suitable type of connection of the second end 180 of the corrugated tube to the rest of the tool could be provided.

Figure 17:
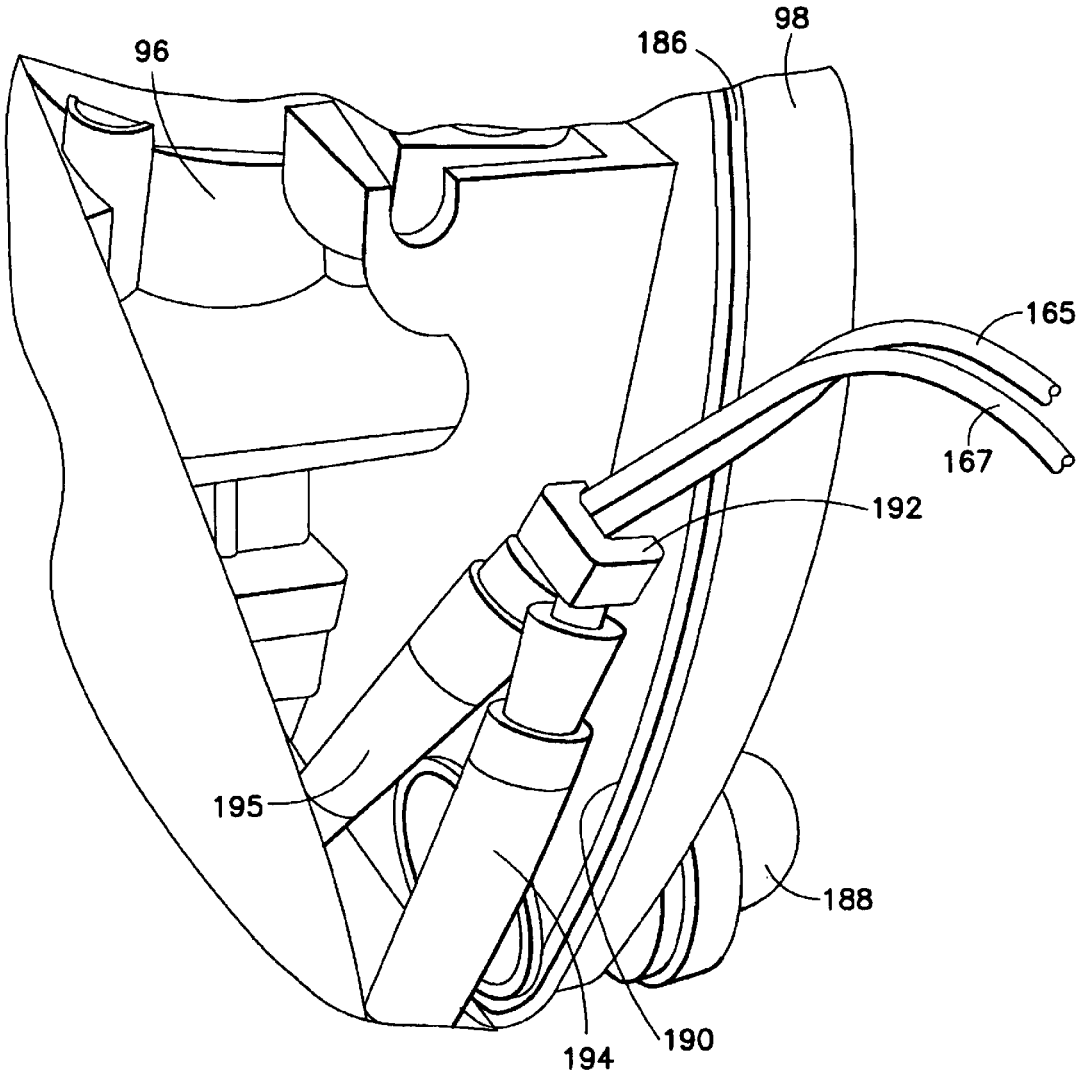
FIG. 17 is a perspective view of the carburetor and air filter base plate shown with the carburetor cover removed.

Referring now also to FIG. 17, portions of the carburetor 96 and the air filter housing 98 are shown. The air filter housing 98 comprises the carburetor cover 182 and a base plate 186. The base plate 186 is fixedly attached to the carburetor 96. Base plate 186 has a fuel primer bulb 188 fixedly attached thereto. The air filter (not shown) is captured between the base plate 186 and the carburetor cover 182. The inner facing exterior side 190 of the base plate 186 includes a projection or clip 192. The clip 192 is adapted to capture and retain portions of the electrical wires 165, 167. Thus, the clip 192 can retain portions of the wires 165, 167 on the base plate 186. In a preferred embodiment, the air cleaner cover base plate 186 is comprised of molded plastic. The clip 192 is preferably molded as part of the base plate 186. However, in alternate embodiments, the clip 192 could be a separate member which is attached to the base plate or attached to another component of the tool 10.

The electrical wires 165, 167 are attached by electrical connectors 194, 195 to electrical wires which lead to the ignition system of the engine 12. During assembly of the tool 10, the lengths of the wires 165, 167 must be long enough to allow connection of the various different components with each other without hindering the assembly person during assembly. However, once all of the components are assembled, the lengths of the wires 165, 167 are relatively long and might otherwise dangle out from under the carburetor cover 182. Such dangling wires could be prone to damage or unintentional and undesirable pulling forces during normal use and storage of the tool. A pull force on the wires could result in an accidental disconnect of the wires at the connectors 194, 195 or accidental cutting of the dangling wires.

The clip 192 allows excess lengths of the wires 165, 167 to be fixedly located or compactly stored against the base plate 168 and prevented from dangling below the carburetor 96. However, in alternate embodiments, any suitable type of system for preventing the electrical wires 165, 167 from dangling beneath the carburetor 96 could be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A power tool comprising:

a main section comprising an internal combustion engine and a housing at least partially surrounding the engine, the engine comprising a cylinder, a spark plug, and a muffler; and a handle shaft extending from the main section, the shaft forming a handle for the power tool and housing a drive shaft from the engine therein, wherein the housing forms a cover section over a transmission assembly between the engine and the drive shaft, an air inlet at the front of the housing and an air outlet at a rear of the housing, wherein the cover section comprises a scroll form to channel air flow pushed by the transmission assembly over the transmission assembly, to the cylinder and the muffler of the engine, and out the air outlet at the rear of the housing, and wherein, the housing further comprises a spark plug boot to substantially prevent air from exiting the housing at the spark plug.

2. A power tool as in claim 1 wherein the power tool comprises a string trimmer having a cutting head at an end of the handle shaft.

3. A power tool as in claim 1 wherein the housing is comprised of two molded plastic pieces comprising a front piece and a rear piece, the front piece having the cover section formed therein and an aperture through the cover section having the drive shaft extend therethrough.

4. A power tool as in claim 1 wherein the housing covers the muffler of the engine.

5. A power tool as in claim 1 wherein the housing comprises a main section having a spark plug aperture therethrough, an outward extending projection extending from the main section, and the spark plug boot is removably connected to the main section, wherein the spark plug extends through the aperture in the main section of the housing, wherein boot is mounted on the projection, and wherein the spark plug boot covers the projection and the aperture.

6. A power tool as in claim 5 wherein the spark plug boot comprises an electrical connector connected to the spark plug.

7. A power tool as in claim 1 wherein the spark plug boot comprises two lateral finger grip side grooves and substantially closed front and rear ends.

8. A power tool as in claim 7 wherein the spark plug boot comprises raised ridges in the lateral finger grip side grooves.

9. A power tool as in claim 1 wherein the main section further comprises a starter connected to a rear end of the engine, and a bumper connected to a housing of the starter, wherein the bumper is comprised of a different material than the housing of the starter, wherein the different material is adapted to at least partially resiliently absorb physical force, and wherein the bumper extends past the rear end of the housing of the starter.

10. A power tool as in claim 1 wherein the handle shaft comprises a coupling for removably connecting the handle shaft to a working end shaft assembly.

11. A power tool as in claim 10 wherein the coupling comprises a tightening system for fixedly attaching the handle shaft onto the working end shaft assembly, the tightening system having a threaded shaft and a hand knob threadingly mounted on the threaded shaft, the threaded shaft having a head stationarily mounted with a first section of the handle shaft, and the hand knob having a main section threadingly mounted on the threaded shaft and an overmolded section on the main section, and wherein the overmolded section forms a raised shaped surface for more secure gripping by a user.

12. A power tool as in claim 2 further comprising at least two control cables extending from a user actuated control section of the handle shaft to the engine, and a flexible corrugated tube extending between the handle shaft and the engine which at least partially surrounds the two control cables.

13. A power tool as in claim 1 further comprising an air cleaner housing connected to the engine, the air cleaner housing comprising a base plate fixedly connected to the engine and a cover removably connected to the base plate, wherein the base plate comprises at least one clip on an exterior side of the base plate which is adapted to mechanically secure an electrical wire against the base plate.

* * * * *